US007819102B2

(12) United States Patent
Maehara et al.

(10) Patent No.: US 7,819,102 B2
(45) Date of Patent: Oct. 26, 2010

(54) VALVE DRIVING DEVICE FOR INTERNAL COMBUSTION ENGINE

(75) Inventors: Toshiyuki Maehara, Susono (JP); Shuichi Ezaki, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 377 days.

(21) Appl. No.: 11/990,846

(22) PCT Filed: May 29, 2007

(86) PCT No.: PCT/IB2007/001401

§ 371 (c)(1),
(2), (4) Date: Feb. 22, 2008

(87) PCT Pub. No.: WO2007/138451

PCT Pub. Date: Dec. 6, 2007

(65) Prior Publication Data

US 2009/0101097 A1 Apr. 23, 2009

(30) Foreign Application Priority Data

May 29, 2006 (JP) ..... 2006-148438

(51) Int. Cl.
*F01L 3/10* (2006.01)

(52) U.S. Cl. ..... 123/90.65; 123/90.16; 123/90.39; 123/90.44; 74/559

(58) Field of Classification Search ..... 123/90.16, 123/90.27, 90.31, 90.39, 90.44, 90.65, 90.66; 74/559, 567, 569
See application file for complete search history.

(56) References Cited

U.S. PATENT DOCUMENTS

| | | | | |
|---|---|---|---|---|
| 6,135,075 | A | 10/2000 | Boertje et al. | |
| 7,281,504 | B2 * | 10/2007 | Fujita et al. | 123/90.16 |

FOREIGN PATENT DOCUMENTS

| | | | |
|---|---|---|---|
| DE | 100 12 400 | A1 | 9/2001 |
| DE | 10 2004 004 643 | A1 | 8/2005 |
| EP | 1 557 540 | A1 | 7/2005 |
| JP | U 58-154803 | | 10/1983 |
| JP | U 59-9138 | | 1/1984 |
| JP | A 7-42511 | | 2/1995 |
| JP | A 10-274013 | | 10/1998 |
| JP | A 2004-521235 | | 7/2004 |
| JP | A-2004-521235 | | 7/2004 |
| JP | A 2005-23804 | | 1/2005 |
| WO | WO 02/095193 | A1 | 11/2002 |

OTHER PUBLICATIONS

Notification of Reason(s) for Refusal issued in Japanese Patent Application No. 2006-148438; mailed Jun. 22, 2010; with partial English-language translation.

* cited by examiner

*Primary Examiner*—Ching Chang
(74) *Attorney, Agent, or Firm*—Oliff & Berridge, PLC

(57) ABSTRACT

A lost motion spring is disposed to contact at one end an oscillating member interposed between a cam and a valve for synchronizing the oscillating of the valve with the rotation of the cam. The lost motion spring impels the oscillating member toward the cam. A spring support shaft is provided for supporting a second portion of the lost motion spring. A spring position adjustment mechanism is provided for adjusting the mounting position of the lost motion spring relative to the spring support shaft.

8 Claims, 16 Drawing Sheets

VALVE DRIVING DEVICE FOR INTERNAL COMBUSTION ENGINE

BACKGROUND OF THE INVENTION

1. Field of the Invention

The present invention relates to a valve driving device for an internal combustion engine, and more particularly to a valve driving device for an internal combustion engine in which an oscillating member is interposed between a cam and a valve to synchronize the oscillation of the valve with the rotation of a camshaft.

2. Description of the Related Art

A conventional variable valve driving device for an internal combustion engine is described in, for example, Japanese Patent Application Publication No. JP-A-2004-521235, that mechanically changes the duration and lift of a valve. This type of conventional variable valve driving device includes a return spring (torsion coil spring) that impels a pivot lever (oscillating member), interposed between a cam and a valve, against the cam.

The variations in the shape of the torsion springs are inherent in the production process. In the variable valve driving device of the above related art, the torsion spring impels the pivot lever to oscillate within a predefined oscillating range. Therefore, such variations in shape of torsion springs can cause some torsion springs, incorporated in the valve driving device, to generate a greater impelling force, and others to generate a smaller impelling force, than the target value.

As a result, the torsion springs with an excessively large impelling force may not be able to satisfy the allowable stress for the required fatigue strength, thus providing only reduced durability. On the other hand, those torsion springs with an excessively small spring force may not be able to provide sufficient impelling force for the inertial force of valve driving components (such as the above oscillating member) when the engine speed is high. Such an insufficient spring force at high engine speed does not permit the valve driving components to maintain synchronous operation with rotation of the cam (i.e., a so-called jump occurs), thus requiring the allowable speed of the internal combustion engine to be reduced.

In the conventional variable valve driving device described above, the length of one arm of the torsion spring for contacting the pivot lever is increased to reduce its spring constant. According to such an approach, changes in spring force due to variations in shape of torsion springs can be reduced. However, increasing the size of the torsion spring, impairs the mountability of the variable valve driving device to the internal combustion engine.

SUMMARY OF THE INVENTION

The present invention provides a valve driving device for an internal combustion engine that allows for variations in shape of torsion springs as a result of mass production, and that also improves mountability to the internal combustion engine.

A first aspect of the present invention provides a valve driving device for an internal combustion engine, that includes an oscillating member interposed between a cam and a valve to synchronize the oscillation of the valve with the cam, characterized by including: a torsion spring, having a first portion and a second portion, that contacts the oscillating member at the first portion end and impels the oscillating member toward the cam; a support part that supports the second portion of the torsion spring; and a spring position adjustment mechanism that adjusts a mounting position of the torsion spring relative to the support part.

In the first aspect, the spring position adjustment mechanism may include an adjustment member that includes a projection projecting from the support part, the second portion of the torsion spring may surround the projection, the adjustment member may be rotatably mounted on the support part, and the projection may have a cam-shaped peripheral surface that contacts the second portion of the torsion spring.

In the first aspect, the spring position adjustment mechanism may include an adjustment member having a projection projecting from the support part, the second portion of the torsion spring may be formed to surround the projection, the projection may include a cylindrical portion that contacts the second portion, and the spring position adjustment mechanism adjusts the mounting position of the torsion spring relative to the support part by using the adjustment member including the cylindrical portion, in contact with the torsion spring, having a different outer diameter.

In the above aspects, the adjustment member may be mounted on the support part in such an orientation that when a head cover of the internal combustion engine removed, the adjustment member is accessible in a substantially axial direction of the adjustment member.

According to the first aspect of the present invention, the orientation of the first portion of a torsion spring that is mounted on the valve driving device may be adjusted by adjusting the mounting position of the torsion spring relative to the support part through the spring position adjustment mechanism. Thus, even if a torsion spring with a larger spring constant is used, variations in spring force can be effectively reduced. In this way, the first aspect of the present invention provides a valve driving device for an internal combustion engine that allows for variations in shape of torsion springs as a result of mass production, and that also provides excellent mountability to the internal combustion engine.

In addition, the relative position of the second portion of the torsion spring and the projection of the adjustment member may be changed by rotating the cam-shaped projection of the adjustment member. In this way, the orientation of the first portion of a torsion spring mounted on the valve driving device may be adjusted with a simple construction by adjusting the mounting position of the torsion spring relative to the support part through the spring position adjustment mechanism.

Further, the relative position of the second portion of the torsion spring and the projection of the adjustment member can be changed by replacing the adjustment member with one including a cylindrical portion having a different outer diameter. In this way, the orientation of the first portion of a torsion spring mounted on the valve driving device may be adjusted with a simple construction by adjusting the mounting position of the torsion spring relative to the support part through the spring position adjustment mechanism.

Furthermore, workability in adjusting the position of a torsion spring mounted on the variable valve driving device is improved. In this way, variations between a plurality of cylinders in spring force of the torsion spring can be easily adjusted with the torsion spring mounted on the valve driving device.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EXAMPLE EMBODIMENTS

Figure 1:
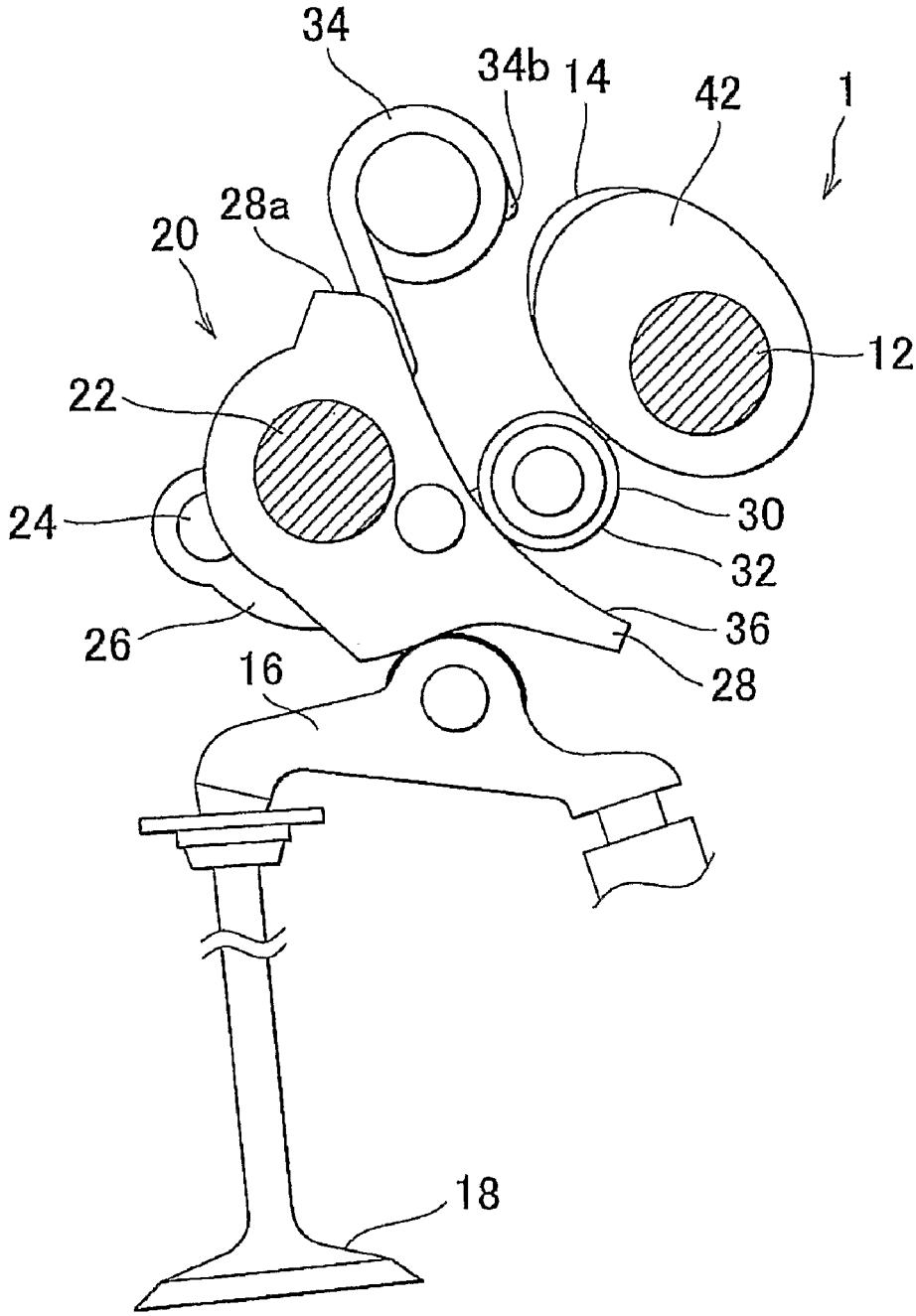
FIG. 1 is a side view showing the construction of a variable valve driving device according to a first embodiment of the present invention.
Figure 2:
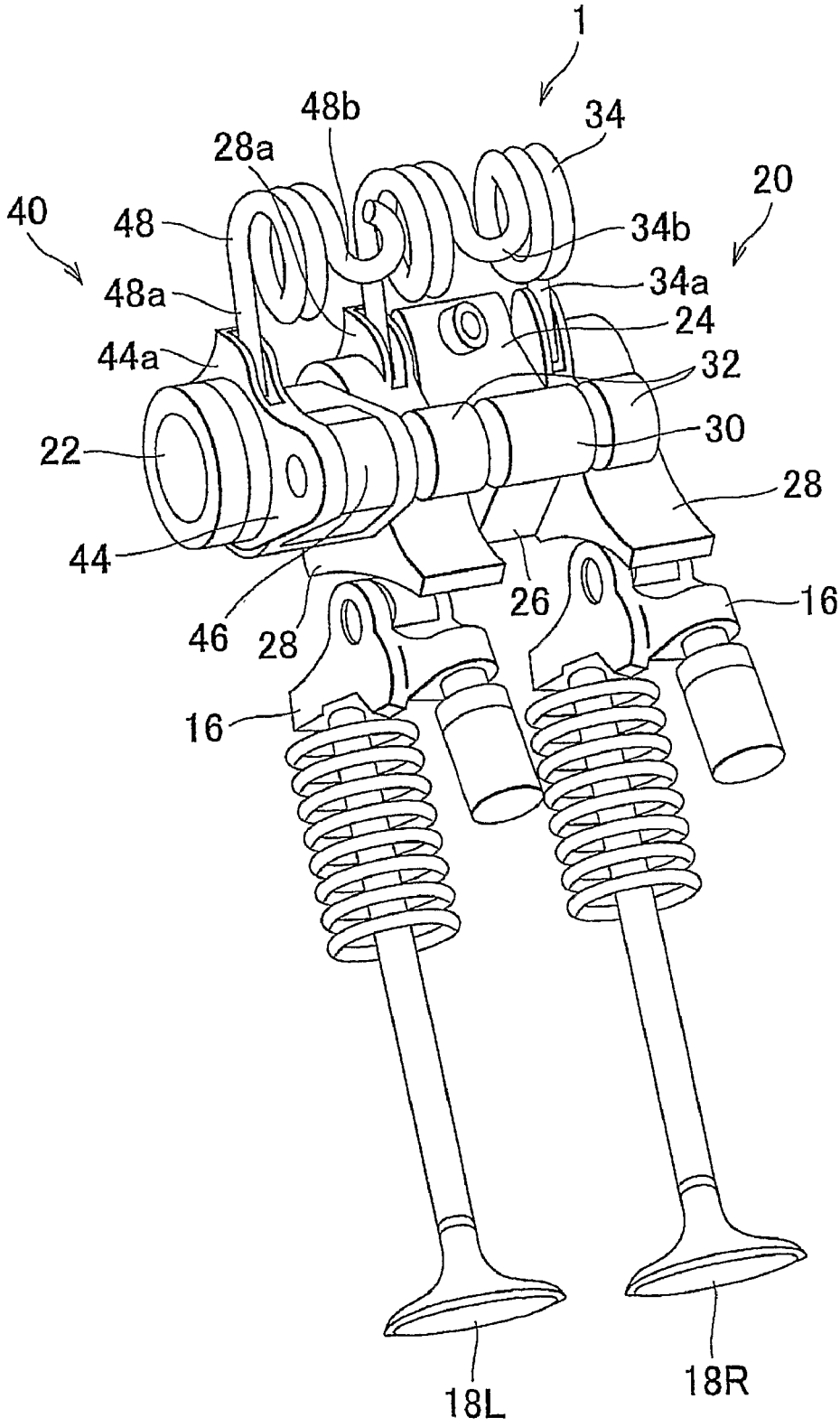
FIG. 2 is a perspective view of the variable valve driving device shown in FIG. 1.

Hereinafter, with reference to FIGS. 1 and 2, a valve driving device for an internal combustion engine according to a first embodiment of the present invention will be described. FIG. 1 is a side view of a variable valve driving device 1 according to the first embodiment of the present invention. More specifically, FIG. 1 shows the cross section of the variable valve driving device 1 taken along a plane passing through a first driving cam 14 provided on a camshaft 12. FIG. 2 is a perspective view of the variable valve driving device 1 shown in FIG. 1. Each cylinder of the internal combustion engine includes two intake valves and two exhaust valves. The device shown in FIGS. 1 and 2 drives the two intake valves, or the two exhaust valves, provided for each cylinder.

The variable valve driving device 1 mechanically changes the valve opening characteristics (such as lift and duration) of a valve 18. Specifically, the variable valve driving device 1 includes a rocker arm type mechanical valve driving mechanism, by which rotation of the camshaft 12 is converted into oscillating motion of a rocker arm 16 by the first driving cam 14 provided on the camshaft 12, and then into vertical lifting motion of the valve 18 supported by the rocker arm 16. The variable valve driving device 1 drives the rocker arm 16 through a variable valve driving mechanism 20 interposed between the first driving cam 14 and the rocker arm 16, rather than directly through the first driving cam 14. The variable valve driving mechanism 20 may continuously change the oscillating motion of the rocker arm 16 in response to the rotation of the first driving cam 14. The variable valve driving device 1 variably controls the variable valve driving mechanism 20 to change the oscillating amount and timing of the rocker arm 16, so as to continuously change the lift and duration of the valve 18.

The variable valve driving mechanism 20 includes as its main constituent parts a control shaft 22, a control arm 24, a link arm 26, an oscillating cam arm 28, a first roller 30, and a second roller 32. The control shaft 22 is disposed parallel to the camshaft 12. The rotational angle of the control shaft 22 may be controlled to an arbitrary angle by an actuator (not shown) (such as motor, for example).

A retention part 28*a* of the oscillating cam arm 28 retains an end 34*a* of a lost motion spring 34 (which may hereinafter be simply referred to as "spring 34"). The spring 34 is a torsion coil spring that has a circular cross section. In the construction shown in FIG. 2, one torsion coil spring as the spring 34 is used for two oscillating cam arms 28.

A curved portion 34*b* is formed in the central portion of the spring 34. The spring 34 is mounted on a cylinder head (not shown) (or on a support member such as cam carrier) via a spring support shaft 62 (see FIGS. 5A to 5C). The mounting position of the spring 34 to the variable valve driving device 1 is defined by the end 34*a* retained by the retention part 28*a* and the curved portion 34*b* retained by the spring support shaft 62.

An impelling force from the lost motion spring 34 impels a slide surface 36 formed on the oscillating cam arm 28 against the second roller 32, thereby the first roller 30 against the first driving cam 14. The first and second rollers 30 and 32 are thus positioned as interposed between the slide surface 36 and the peripheral surface of the first driving cam 14 from both sides.

According to the variable valve driving mechanism 20 constructed as described above, changing the rotational position of the control shaft 22 changes the position of the second roller 32 on the slide surface 36, thus changing the oscillating range of the oscillating cam arm 28 during lifting operation. Therefore, the lift and duration of the valve 18 may be variably adjusted by controlling the rotational position of the control shaft 22. The construction of the variable valve driving mechanism 20 for variably controlling the valve opening characteristics of the valve 18 is similar to that described in JP-A-2006-70738, for examples and thus will not be described in detail herein.

The variable valve driving device 1 also includes a fixed valve driving mechanism 40 for providing fixed valve opening characteristics to one (in FIG. 2, the valve 18L on the left side) of the two valves 18 disposed side by side. The variable valve driving device 1 includes a valve switching mechanism that selectively switches operation of the valve 18L between the variable valve driving mechanism 29L or the fixed valve driving mechanism 40.

In addition to the first driving cam 14, the camshaft 12 includes for each cylinder a second driving cam 42 disposed adjacent to the first driving cam 14, as shown in FIG. 1. The fixed valve driving mechanism 40 shown in FIG. 2 is interposed between the second driving cam 42 and the oscillating cam arm 28L. The fixed valve driving mechanism 40 allows the oscillating cam arm 28L to oscillate in conjunction with the rotation of the second driving cam 42. The fixed valve driving mechanism 40 includes a large lift arm 44 that is driven by the second driving cam 42.

The large lift arm 44 is disposed on the control shaft 22 next to the oscillating cam arm 28L so as to oscillate independently of the oscillating cam arm 28L. The large lift arm 44 rotatably supports an input roller 46 that contacts the peripheral surface of the second driving cam 42. A retention part 44*a* of the large lift arm 44 retains a lost motion spring 48, as in the case with the oscillating cam arm 28. The spring force of the lost motion spring 48 acts as an impelling force to press the input roller 46 against the peripheral surface of the second driving cam 42.

The valve switching mechanism according to this embodiment is constructed to couple and decouple the large lift arm 44 and the oscillating cam arm 28L. The specific construction of the valve switching mechanism is unnecessary to understand the present invention, and thus is not described in detail herein. By way of illustration, the following construction may be used. One of the large lift arm 44 and the oscillating cam arm 28L may be provided with a pin that is projected toward the other by, for example, hydraulic pressure, while the other is provided with a pin hole that receives the pin. The pin and the pin hole are aligned with each other when the oscillating cam arm 28L and the large lift arm 44 are in a predetermined relative positional relationship. According to such a construction, when the oscillating cam arm 28L and the large lift arm 44 are coupled to each other via the pin, the pressing force of the second driving cam 42 is transmitted to the valve 18L via the large lift arm 44, the oscillating cam arm 28L and the rocker arm 16. As a result, only the valve opening characteristics of the valve 18 will be controlled in a fixed manner, irrespective of the rotational position of the control shaft 22.

Figure 3A:
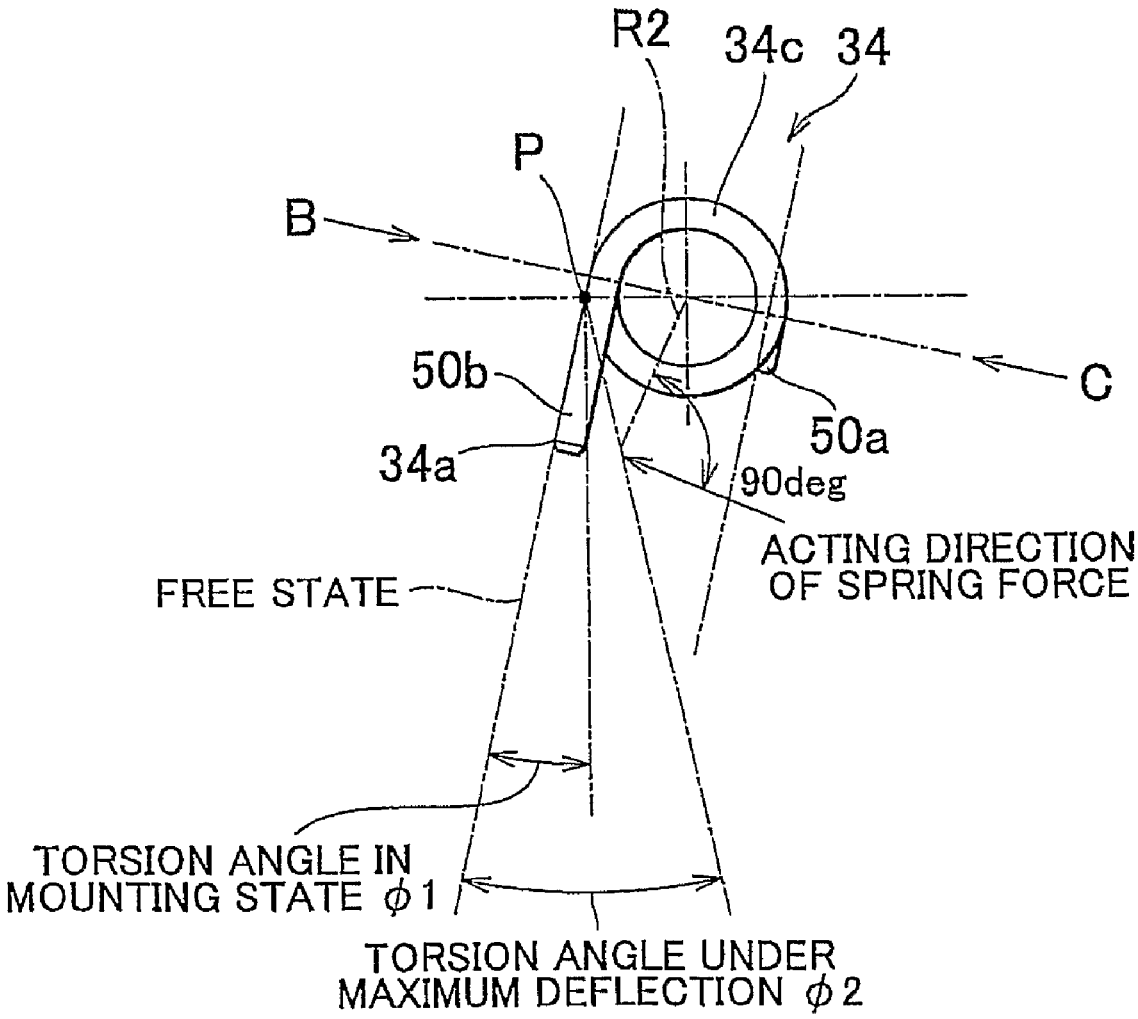
FIGS. 3A to 3C illustrate the construction of a lost motion spring (for an oscillating cam arm) shown in FIG. 2.
Figure 3B:
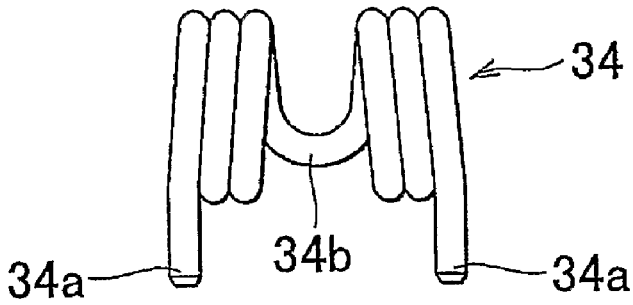
Figure 3C:
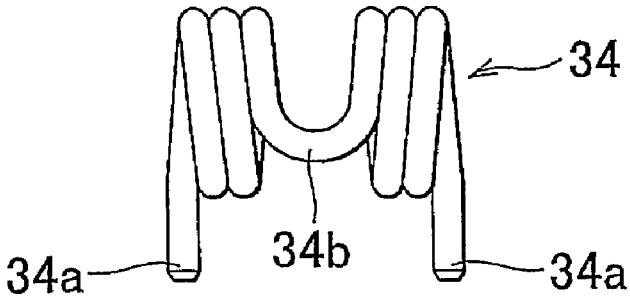

FIGS. 3A to 3C illustrate the construction of the lost motion spring 34 (for an oscillating cam arm) shown in FIG. 2. More specifically, FIG. 3A illustrates the spring 34 as viewed in the direction of an axis passing through the center of a coiled portion 34*c*, FIG. 3B illustrates the spring 34 as viewed in the direction of the arrow B in FIG. 3A, and FIG. 3C illustrates the spring 34 as viewed in the direction of the arrow C in FIG. 3A.

FIGS. 3A to 3C shows a spring 34 that is not loaded. Here, a portion of the spring 34 that departs from the circumference of the coiled portion 34*c* on the curved portion 34*b* side is referred to as a first arm 50*a*, while a portion of the spring 34 that departs from the circumference of the coiled portion 34*c* on the other side, that is, on the end 34*a* side is referred to as a second arm 50*b*. With the spring 34 mounted on the variable valve driving device 1, the second arm 50*b* receives a load from the oscillating cam arm 28. The spring 34 generates a spring force against the load from the oscillating cam arm 28. Here, as shown in FIG. 3A, the length of the line segment connecting the center of the coiled portion 34*c* and the end 34*a* (load acting point) of the second arm 50*b* is referred to as "load acting radius R2", and the direction perpendicular to the line segment is defined as the acting direction of the spring force mentioned above.

The point where the outer line of the second arm 50*b* and the outer line of the circumference of the coiled portion 34*c* intersect is defined as "point P". With the spring 34 mounted on the variable valve driving device 1 (with the valve 18 closed), the spring 34 is twisted around the point P in FIG. 3A by a torsion angle $\phi$1, compared to the free state, which narrows the angle between the two arms 50*a* and 50*b*. When the oscillating cam arm 28 receives the pressing force of the first driving cam 14 to start oscillating while the valve 18 is in lifting operation, the torsion angle $\phi$ increases. At this time, the torsion angle $\phi$ reaches an angle $\phi$2 under maximum deflection (at the peak of the lift curve).

Figure 4A:
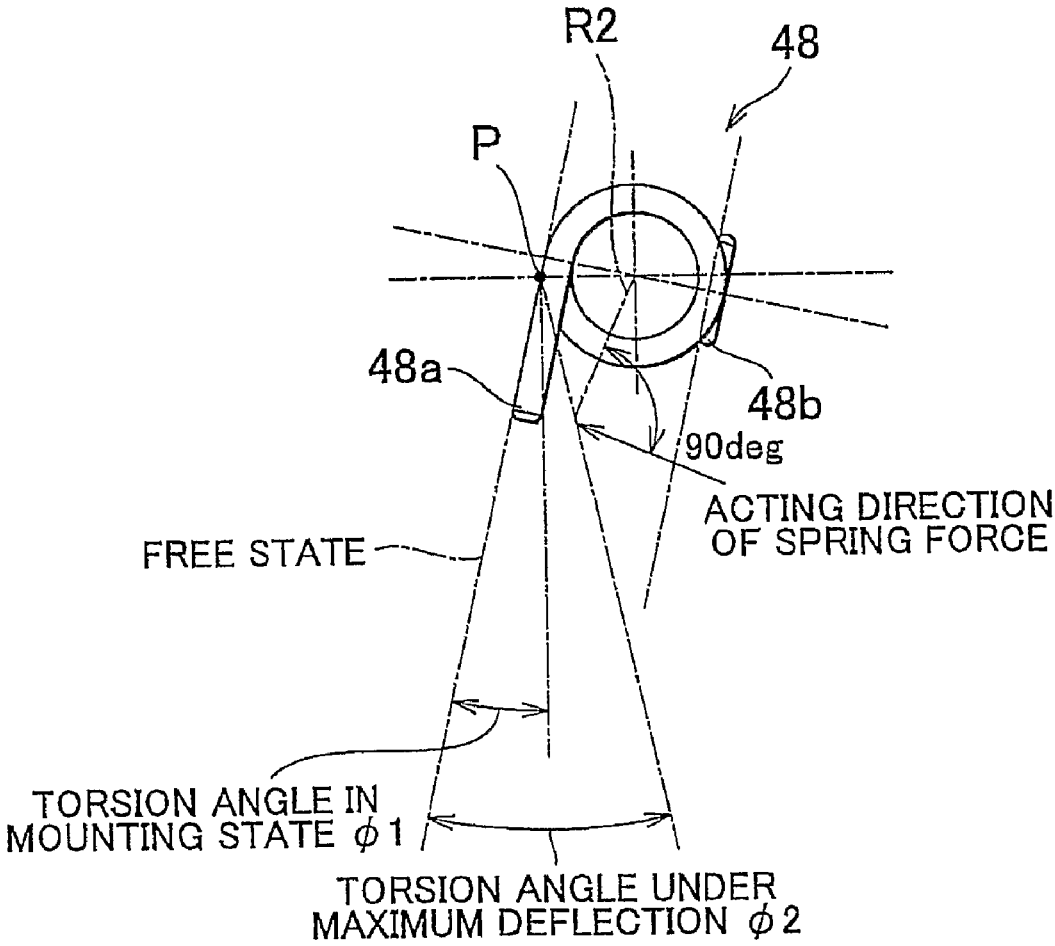
FIGS. 4A to 4C illustrate the construction of a lost motion spring (for a large lift arm) shown in FIG. 2.
Figure 4B:
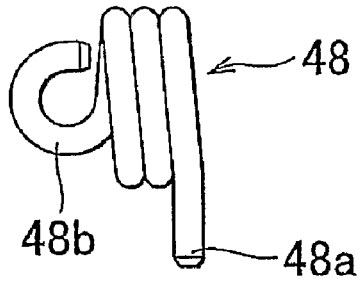
Figure 4C:
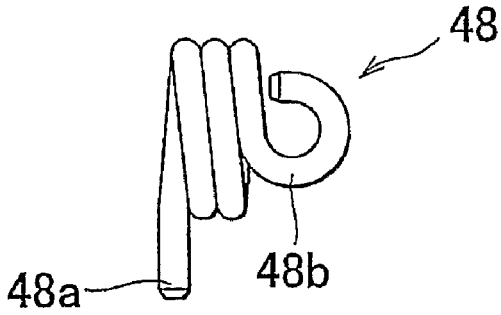

FIGS. 4A to 4C illustrate the construction of the lost motion spring 48 (for a large lift arm) shown in FIG. 2. More specifically, FIGS. 4A to 4C illustrate the spring 48 as viewed in the same directions as it is viewed in FIGS. 3A to 3C, respectively. The construction of the spring 48 for the large lift arm 44 is similar to that of the spring 34 discussed above, except that the torsion coil spring is constructed independently for one large lift arm 44. That is, the only difference of the spring 48 from the spring 34 is that an end 48*a* of the spring 48 on the other side is formed as a curved portion 48*b* that is retained by the spring support shaft 62.

Figure 5A:
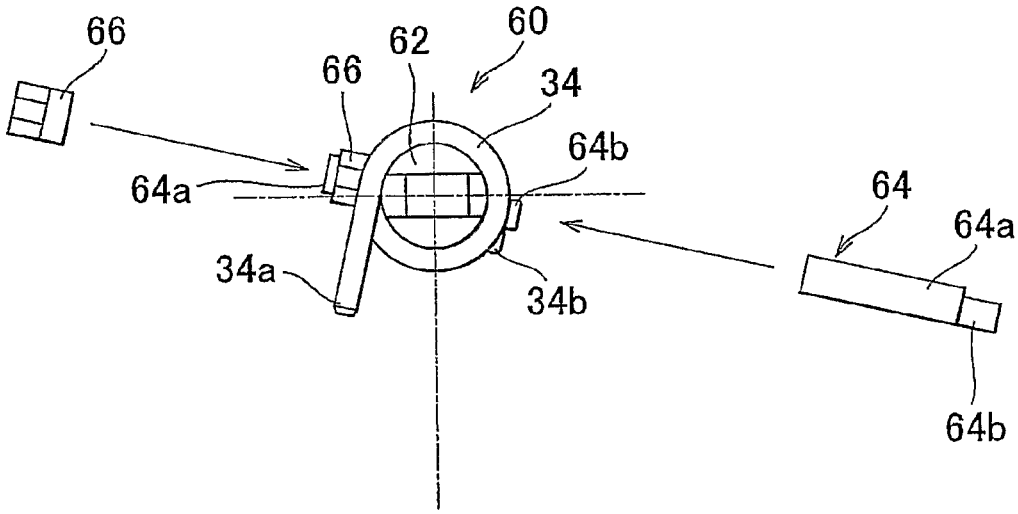
FIGS. 5A to 5C illustrate the construction of a spring position adjustment mechanism.
Figure 5B:
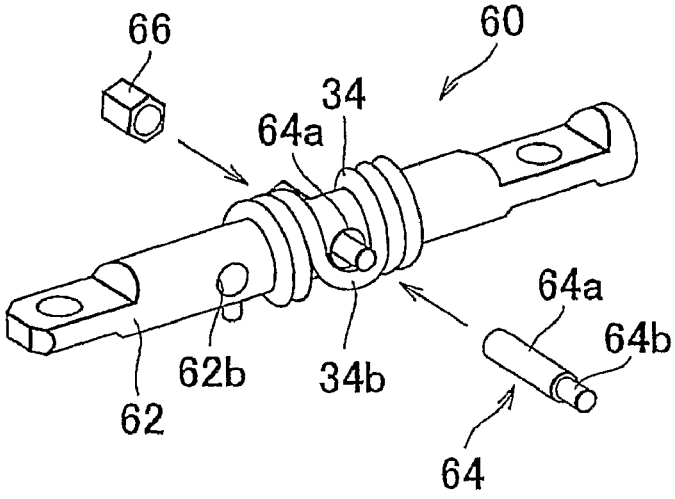
Figure 5C:
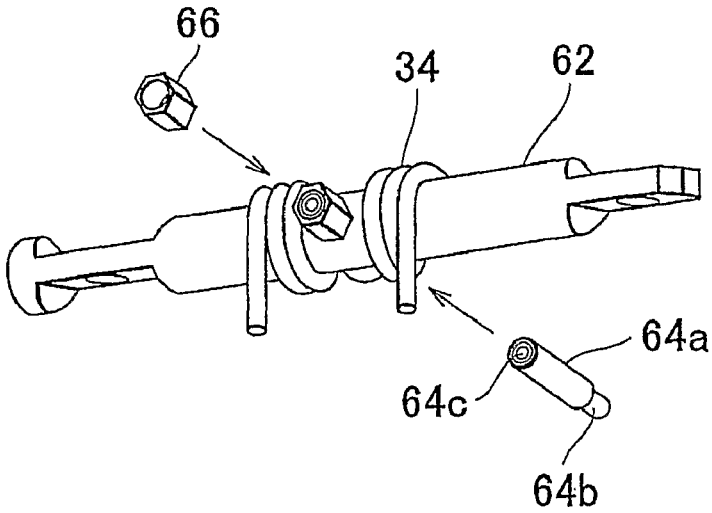

Now, with reference to FIGS. 5A to 5C and 6, the construction of a spring position adjustment mechanism 60 (which may hereinafter be simply referred to as "adjustment mechanism 60") for adjusting the mounting position of the lost motion spring will be described. FIGS. 5A to 5C illustrate the construction of the spring position adjustment mechanism 60. More specifically, FIG. 5A illustrates the spring position adjustment mechanism 60 as viewed along the axis of the spring support shaft 62, FIG. 5B illustrates the spring position adjustment mechanism 60 as viewed from an adjustment screw 64 side, and FIG. 5C illustrates the spring position adjustment mechanism 60 as viewed from a fixation nut 66 side. FIGS. 5A to 5C illustrate the adjustment screw 64 and the fixation nut 66 both before and after they are assembled to the spring support shaft 62.

As shown in FIGS. 5A to 5C, the lost motion spring 34 is wound to the spring support shaft 62. The spring support shaft 62 is formed with a threaded hole 62*a* in a direction perpendicular to the axis of the spring support shaft 62. The inner wall of the threaded hole 62*a* is formed with female threads. The adjustment mechanism 60 includes an adjustment screw 64 for meshing the threaded hole 62*a*.

The adjustment screw 64 includes a male-threaded portion 64*a* formed on its peripheral surface with male threads, and a cam-shaped head 64*b*. An end surface of the adjustment screw 64 on the male-threaded portion 64*a* side is formed with a hexagonal adjustment groove 64*c* (inner hexagonal groove) for adjusting the rotational position of the screw 64.

The adjustment screw 64 is screwed into the spring support shaft 62 to a position where the cam-shaped head 64*b* contacts the curved portion 34*b* of the spring 34. The adjustment mechanism 60 includes a fixation nut 66 that fixes the rotational position of the adjustment screw 64 relative to the spring support shaft 62. The adjustment screw 64 is screwed into the spring support shaft 62 to a predetermined rotational position with the male-threaded portion 64*a* projecting from the other side of the spring support shaft 62. The fixation nut 66 is meshed with the male-threaded portion 64*a* on the other side of the spring support shaft 62. The rotational position of the adjustment screw 64 is fixed by the frictional force between the spring support shaft 62 and the fixation nut 66 when the fixation nut 66 is fastened.

Figure 6:
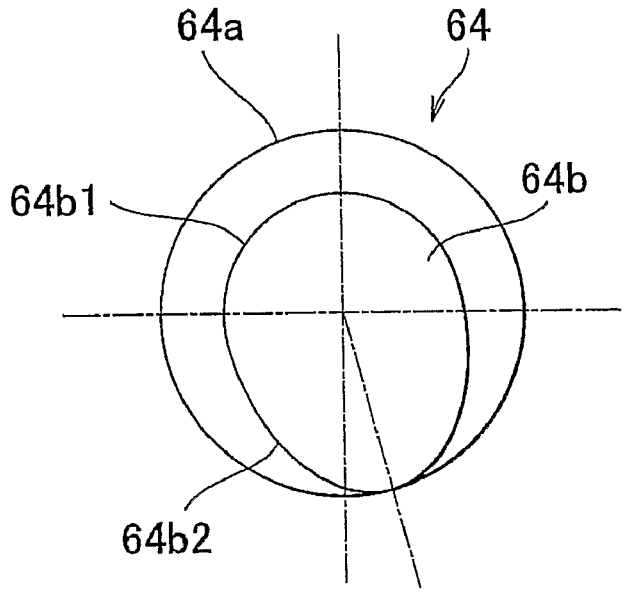
FIG. 6 shows a cam-shaped head of an adjustment screw shown in FIGS. 5A to 5C as viewed axially of the screw.

FIG. 6 shows the cam-shaped head 64*b* of the adjustment screw 64 shown in FIGS. 5A to 5C as viewed along the axis of the screw 64. As shown in FIG. 6, the cam-shaped head 64*b* includes a base circular portion 64*b*1 that has smaller diameter than and is concentric with the male-threaded portion 64*a*, and a cam nose portion 64*b*2 that has the same diameter at its top as the male-threaded portion 64*a*. The spring position adjustment mechanism 60 according to this embodiment includes the spring support shaft 62, the adjustment screw 64 and the fixation nut 66 described above.

Figure 7:
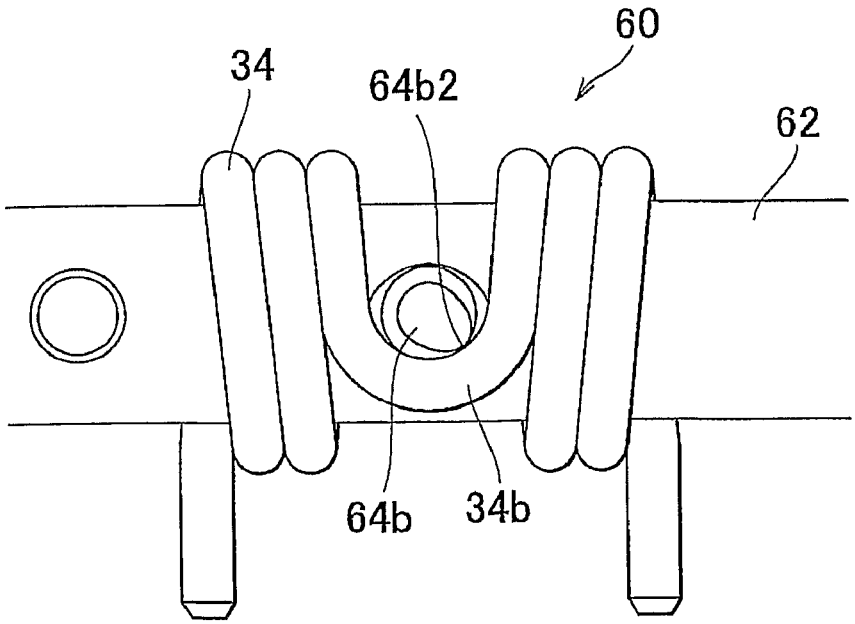
FIG. 7 shows the central position of the mount position of a first arm.

Now, with reference to FIGS. 7 to 9, a method of adjusting the mounting position of the lost motion spring 34 through the spring position adjustment mechanism 60 will be described. FIG. 7 shows the central position of the mounting position of the first arm 50*a* FIG. 7 shows the state where the cam-shaped head 64*b* contacts the curved portion 34*b* at an intermediate position of the cam nose portion 64*b*2. Here, the mounting position of the first arm 50*a* of the spring 34 to the variable valve driving device 1 in such a state is defined as "central position".

Figure 8A:
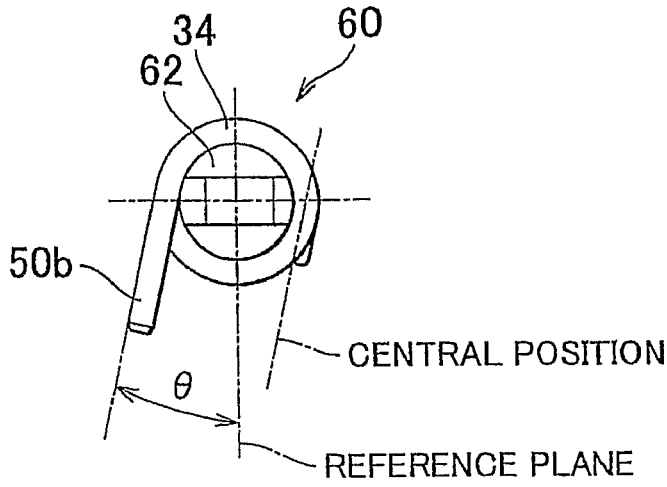
FIGS. 8A to 8C show the lost motion spring mounted on a spring support shaft with the first arm mounted at the central position shown in FIG. 7.
Figure 8B:
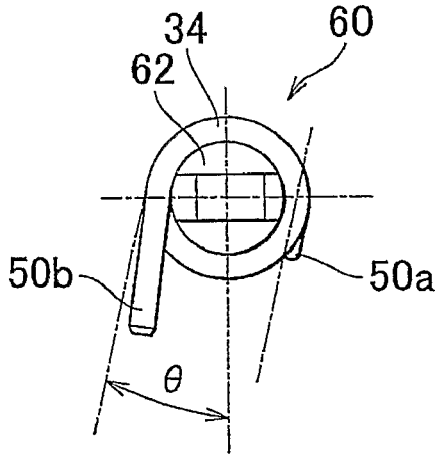
Figure 8C:
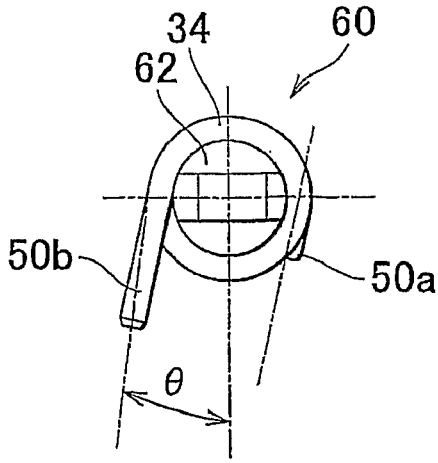

FIGS. 8A to 8C show the lost motion spring 34 mounted on the spring support shaft 62 with the first arm 50*a* mounted at the central position mentioned above. In FIG. 8A, the second arm 50*b* of the spring 34 is in the same direction as the dot and dash line, which indicates the target direction in design, when the spring 34 is mounted on the spring support shaft 62 at the central position. In other words, the spring 34 shown in FIG. 8A is manufactured with no variation in shape from the design value.

The shape of the lost motion spring 34 may vary as a result of manufacture. In FIG. 8B, the second arm 50*b* of the spring 34 is directed more inwardly than the dot and dash line. In other words, the spring shown in FIG. 8B is manufactured with the angle between the first arm 50*a* and the second arm 50*b* narrower than the target shape in design. In the case where such a spring is mounted on the variable valve driving device 1, the spring force is insufficient because only a load below the design target value acts on the spring. In FIG. 5C, the second arm 50*b* of the spring 34 is directed more outwardly than the dot and dash line, opposite to the spring 34 shown in FIG. 8B. In other words, the spring 34 shown in FIG. 8C is manufactured with the angle between the first arm 50*a* and the second arm 50*b* wider than the target shape in design. In the case where such a spring is mounted on the variable valve driving device 1, the spring force is excessively large because a load above the design target value acts on the spring.

In the variable valve driving device 1 including the spring position adjustment mechanism 60 discussed above, the position of the first arm 50*a* of the lost motion spring 34 assembled to the variable valve driving device 1 is determined by the engagement between the curved portion 34*b* and the cam-shaped head 64*b*. Thus, adjusting the rotational position of the adjustment screw 64 can change the positional relationship between the curved portion 34*b* and the cam-shaped head 64*b*, which as a result can change the mounting position of the first arm 50*a*.

Figure 9:
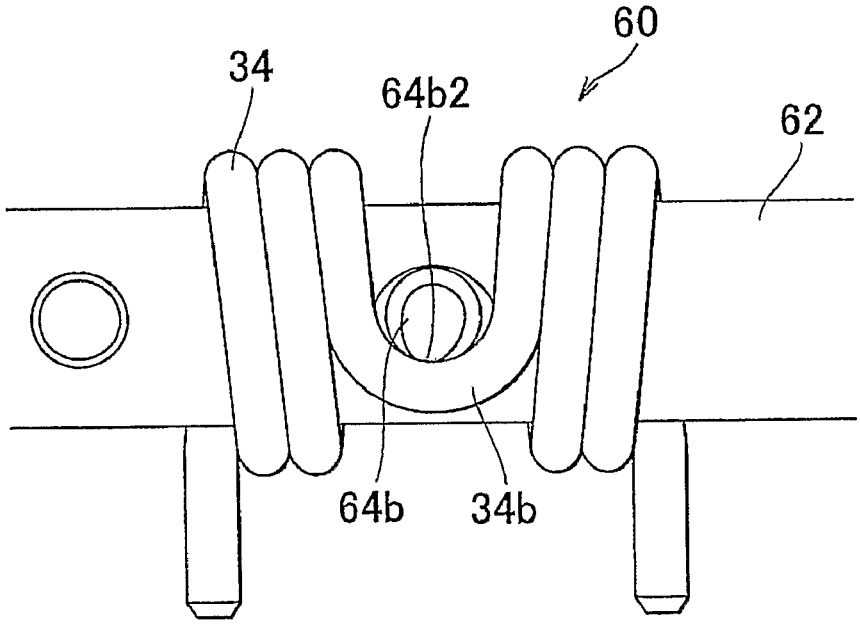
FIG. 9 illustrates an adjustment method to increase the spring force of the lost motion spring.

FIG. 9 illustrates an adjustment method to increase the spring force of the lost motion spring 34. When a spring with two narrow-angled arms, such as the spring 34 shown in FIG. 8B, is used, the fixation nut 66 is loosened, and the rotational position of the adjustment screw 64 is adjusted such that the curved portion 34*b* is contacted by a portion of the cam nose portion 64*b*2 more on the top side, as shown in FIG. 9. As a result, the mounting position of the spring 34 is moved clockwise from the position shown in FIG. 8B. This allows the second arm 50*b* to coincide in direction with the dot and dash line.

Figure 10:
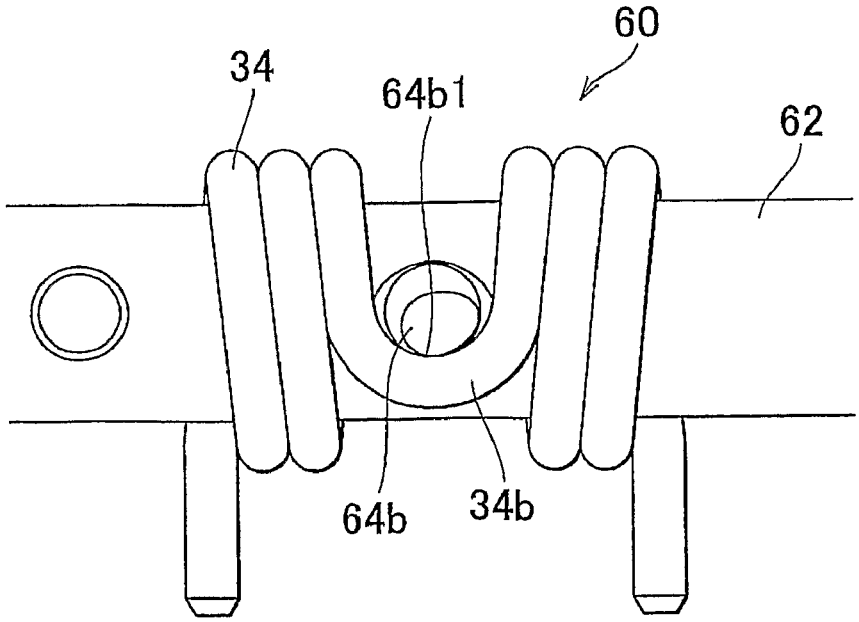
FIG. 10 illustrates an adjustment method to reduce the spring force of the lost motion spring.

FIG. 10 illustrates an adjustment method to reduce the spring force of the lost motion spring 34. In the case where a spring with two wide-angled arms, such as the spring 34 shown in FIG. 8C, is used, the fixation nut 66 is loosened, and the rotational position of the adjustment screw 64 is adjusted such that the curved portion 34*b* is contacted by a peripheral surface more on the base circular portion 64*b*1 side, as shown in FIG. 10. As a result, the mounting position of the spring 34 is moved counterclockwise from the position shown in FIG. 8C. This allows the second arm 50*b* to coincide in direction with the dot and dash line.

The adjustment of the spring position described above may be performed by the following procedure. For example, with the spring 34 mounted on the spring support shaft 62, the rotational position of the adjustment screw 64 is set at the central position. Then, the assembly of the spring support shaft 62 and the spring 34 in this state is set on a predetermined measurement jig to measure the position of the second arm 50*b* relative to the reference plane (see FIGS. 8A to 8C). At this time, if a variation is found in position of the second arm 50*b*, the mounting position of the first arm 50*a* may be adjusted by the methods shown in FIGS. 9 and 10. The spring 34 for each cylinder may be adjusted in the manner described above.

The adjustment of the spring position may also be performed by the following procedure, for example. The assembly in the above state is set on a predetermined measurement jig with a small load acting on the spring 34. The spring force generated at this time is measured to determine whether or not the spring force satisfies the design value. If a difference is found between the measured spring force and the design value, the mounting position of the first arm 50*a* is adjusted by the methods shown in FIGS. 9 and 10 to obtain a spring force satisfying the design value. The spring 34 for each cylinder may be adjusted in the manner described above.

As described above, according to the spring position adjustment mechanism 60 according to this embodiment, adjusting the rotational position of the adjustment screw 64 relative to the spring support shaft 62 changes the mounting angle of the first arm 50*a* relative to the spring support shaft 62. This changes the direction of the second arm 50*b* in the free state (where no load is acting on the spring 34). When the direction of the second arm 50*b* in the free state is changed, the torsion angle ? (see FIG. 8A) of a spring 34 mounted in the variable valve driving device 1 under maximum deflection is also changed. As the torsion angle ? in the free state is reduced, the spring force is reduced. Conversely, as the torsion angle ? in the free state is increased, the spring force is increased. Therefore, the spring force of the lost motion spring 34 mounted on the spring support shaft 62 under maximum deflection may be uniformly set to the design reference value, irrespective of variations in shape of the lost motion spring 34, by changing the direction of the second arm 50*b* through the spring position adjustment mechanism 60.

As shown in FIGS. 5A to 5C, the spring support shaft 62 is formed with a threaded hole 62*b*, positioned adjacent to the threaded hole 62*a*, for adjusting the position of the lost motion spring 48 for the large lift arm 44. The position of the spring 48 can also be adjusted using similar adjustment screw 64 and fixation nut 66, which is not described in detail herein.

Incorporating the spring position adjustment mechanism 60, constructed as described above, into a valve driving device for an internal combustion engine provides the effects as described below with a simple and convenient construction.

First, the mountability of a lost motion spring in the valve driving device is improved. It is difficult to eliminate variations in shape and material of lost motion springs in mass production. A spring with a larger spring constant generates a larger spring force for variations in shape of springs.

Figure 11:
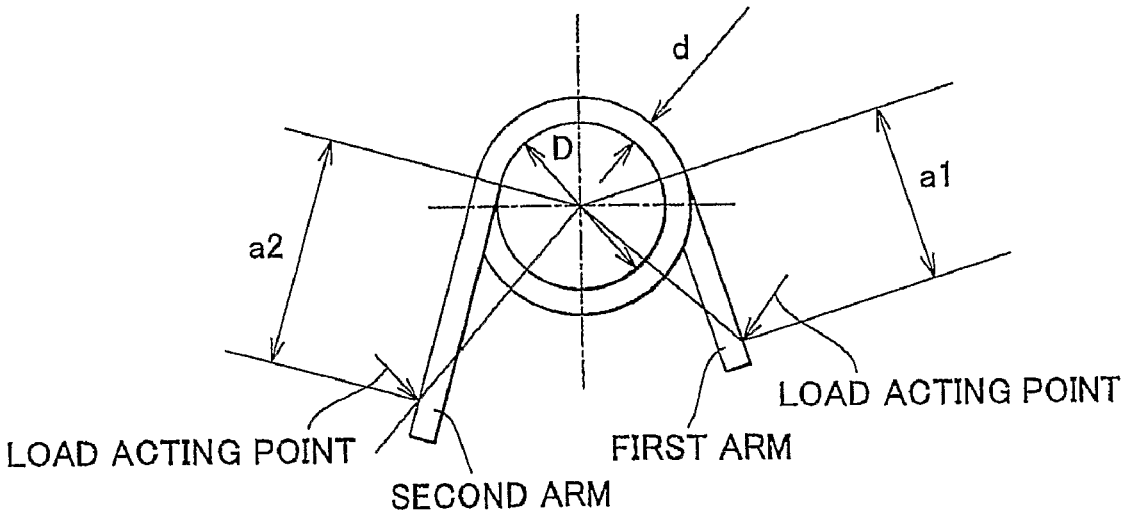
FIG. 11 illustrates how the respective dimensions, etc., of a torsion coil spring are defined.

The spring constant ktd of a torsion coil spring and the specifications of the spring have a relationship represented by the equation (1) given below:

$$ktd=E\cdot p\cdot d^4/(64\cdot(p\cdot D\cdot N+\tfrac{1}{3}\cdot(a1+a2))) \quad (1)$$

where E represents the Young's modulus, d the diameter of the material, D the average diameter of the coil, N the number of windings, a1 the length of the first arm, and a2 the length of the second arm. FIG. 11 illustrates how the respective dimensions, etc., of a torsion coil spring are defined.

The use of a spring with a smaller spring constant is conceivable in order to reduce changes in spring force for variations in shape of springs. However, the use of a spring with a smaller spring constant involves problems as follows. As indicated by the equation (1), it is effective to increase the arm length a1 or a2, the coil average diameter D or the number of windings N, in order to reduce the spring constant. However, increasing the arm length a1 or a2 or the coil average diameter D increases the size of the spring. Also, increasing the number of windings N increases the size of the spring in the axial direction of the camshaft 12. Such attempts to reduce the spring constant result in an increased size of the spring, which deteriorates the mountability of the lost motion spring in the valve driving device. To avoid increasing the size of the spring due to increasing the number of windings N, the use of a spring with a rectangular coil cross section is conceivable, which, however, increases the manufacturing cost of the spring.

To address the above problems, the valve driving device including the spring position adjustment mechanism 60 according to this embodiment adjusts the directions of the arms of a spring in the state of being assembled, thus allowing for the use of a spring with a larger spring constant, that is, a spring of a smaller size. This can favorably improve the mountability of a lost motion spring in a valve driving device, thus achieving the compactness of an internal combustion engine as a whole.

Furthermore, variations between cylinders in spring force of the lost motion spring 34, or the like, due to variations in position of the variable valve driving mechanism 20 and fixed valve driving mechanism 40 side, may be reduced. Specifically, taking the variable valve driving mechanism 20 for an example, variations in shape, and positional deviation when assembled, of all the components of the variable valve driving mechanism 20 and surrounding associated parts such as cylinder head may cause variations between cylinders in lift and duration of the valve 18 when initially assembled. Such variations between cylinders in lift, etc., may be reduced by a separate adjustment mechanism provided to the variable valve driving mechanism 20. Therefore, the position of the oscillating cam arm 28, which contacts the second arm 50*b* of the spring 34, is determined after such adjustment of variations between cylinders in lift, etc. That is, the position of the oscillating cam arm 28 with the spring 34 assembled thereto may vary between cylinders. As a result, such variations between cylinders in position of the oscillating cam arm 28 may cause variations between cylinders in spring force of the spring 34. The spring position adjustment mechanism 60 according to this embodiment may be used to adjust such variations between cylinders in spring force of the spring 34.

Lastly, the spring force of the lost motion springs 34 for all the cylinders may be made uniform, so as to allow for variations in inertial force of the oscillating cam arm 28, the second roller 32, the large lift arm 44, or the like, while oscillating. Specifically, the inertial force of those parts which synchronously oscillate with the rotation of the camshaft 12, such as the oscillating cam arm 28, the second roller 32 and the large lift arm 44, may vary between cylinders because of variations in shape of the parts and positional deviation when assembled. Also, as already discussed, if the spring force of a mounted spring 34 is larger because of variations in shape, the spring force is also larger than the design value when the spring is under maximum deflection. A combination of the spring 34 with a larger spring force and the variable valve driving mechanism 20, or the like, with a larger inertial force cannot satisfy the allowable stress for the required fatigue strength, and the spring 34 cannot secure sufficient durability. Meanwhile, a combination of the spring 34 with a smaller spring force due to variations in shape and the variable valve driving mechanism 20, or the like, with a larger inertial force cannot permit valve driving components such as the oscillating cam arm 28 to maintain synchronous operation with the rotation of the cam (i.e., a so-called jump occurs) when the engine speed is high. In this case, it is necessary to reduce the maximum allowable speed of the internal combustion engine. The spring position adjustment mechanism 60 according to this embodiment can compensate variations between cylinders in spring force due to variations in shape of the spring 34, or the like, provided for each cylinder. Thus, it is possible to always satisfy the required durability of the spring 34, or the like, even if combined with the variable valve driving mechanism 20, or the like, with a larger inertial force, and also to easily uniform the spring force of the spring 34, or the like, for each cylinder to a proper range where a jump as described above can always be prevented.

The oscillating cam arm 28 and the large lift arm 44 in the first embodiment discussed above are embodiments of the "oscillating member" of the present invention, the lost motion springs 34 and 48 embody the "torsion spring", the ends 34*a* and 48*a* of the lost motion springs 34 and 48 embody the "first portion", the curved portions 34*b* and 48*b* of the lost motion springs 34 and 48 are embodiments of the "second portion", and the spring support shaft 62 is an embodiment of the "support part", respectively. Also, the cam-shaped head 64*b* and the adjustment screw 64 are embodiments of the "projection" and "adjustment member" in the present invention, respectively. In addition, the peripheral surface of the cam-shaped head 64*b* (the base circular portion 64*b*1 and the cam nose portion 64*b*2) embodies the "peripheral surface that contacts the second portion" in the present invention.

Figure 12A:
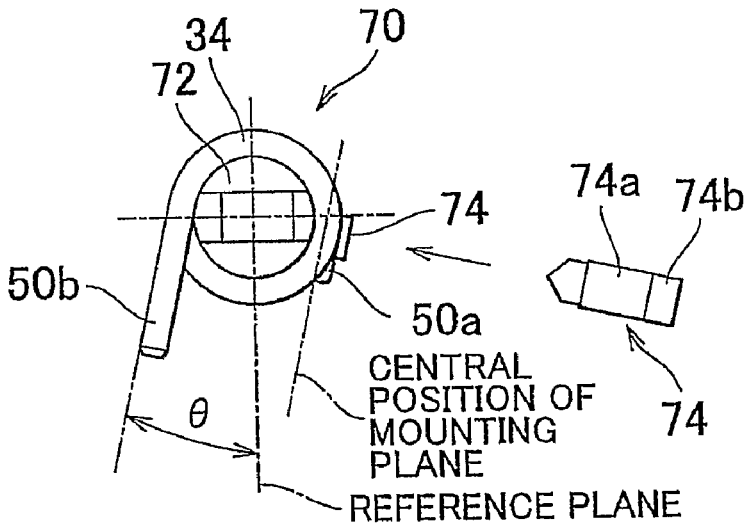
FIGS. 12A and 12B illustrate the construction of a spring position adjustment mechanism according to a second embodiment of the present invention.
Figure 12B:
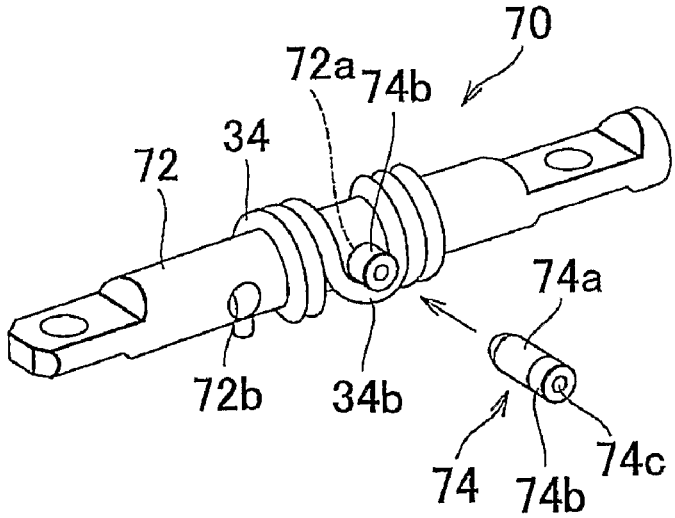

Now, with reference to FIGS. 12A to 14B, a second embodiment of the present invention will be described. FIGS. 12A and 12B illustrate the construction of a spring position adjustment mechanism 70 according to the second embodiment of the present invention. Here, the construction of the lost motion spring 34 for the oscillating cam arm 28 is taken for an example. The construction of the lost motion spring 48 for the large lift arm 44 is basically the same, and thus is not described in detail herein.

As shown in FIGS. 12A and 12B, the spring position adjustment mechanism 70 according to this embodiment is characterized in that the construction of the adjustment screw 74 to be inserted into the spring support shaft 72 is different. More specifically, as shown in FIG. 12A, the spring support shaft 72 is formed with a threaded hole 72*a* in a direction perpendicular to the axis of the spring support shaft 72. The inner wall of the threaded hole 72*a* is formed with female threads. The spring support shaft 72 is also formed with a threaded hole 72*b*, which is similar to the threaded hole 72*a*, for the spring 48.

Meanwhile, as shown in FIG. 12B, a threaded portion 74*a* is formed on a portion of the peripheral surface the adjustment screw 74 with male threads for meshing the threaded hole 72*a*. The adjustment screw 74 also includes a cylindrical portion 74*b* for contacting the curved portion 34*b* of the spring 34 when the adjustment screw 74 is inserted into the threaded hole 72*a*. An end surface of the adjustment screw 74 on the cylindrical portion 74*b* side is formed with a hexagonal adjustment groove 74*c* (inner hexagonal groove) for screwing the adjustment screw 74 into the spring support shaft 72.

Here, the mounting position of the first arm 50*a* when the adjustment screw 74 including the cylindrical portion 74*b* having such an outer diameter as shown in FIGS. 12A and 12B is used is defined as the "central position" discussed above. In FIG. 12A, the second arm 50*b* of the spring 34 is in the same direction as the dot and dash line, which indicates the target direction in design, when the first arm 50*a* is at the central position. In other words, the spring 34 shown in FIG. 12A is manufactured with the target shape in design.

Figure 13A:
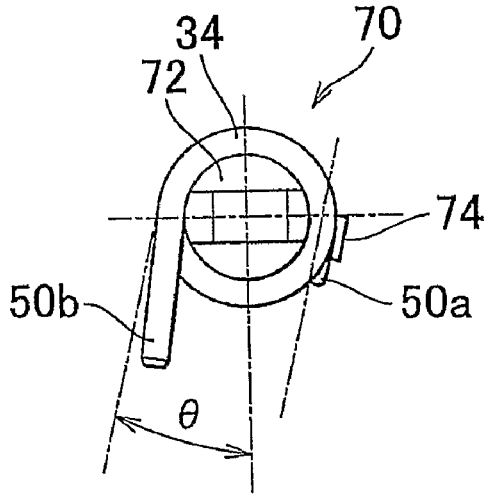
FIGS. 13A and 13B illustrate a method to adjust the mounting position of a spring with two narrow-angled arms.
Figure 13B:
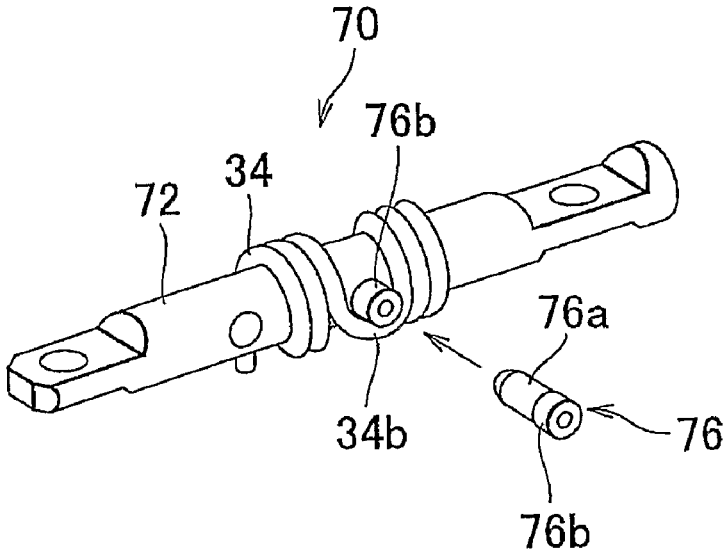

FIGS. 13A and 13B illustrate a method to adjust the mounting position of the spring 34 with two narrow-angled arms. In the case where a spring with two narrow-angled arms, such as the spring 34 shown in FIG. 13A, is used, the adjustment screw 74 is replaced by an adjustment screw 76 formed to include a cylindrical portion 76*b* having a larger outer diameter compared to the screw 74, as shown in FIG. 13B. More specifically, the adjustment screw 76 includes a cylindrical portion 76*b* having a larger outer diameter compared to the adjustment screw 74 including the cylindrical portion 74*b* having an outer diameter achieving the central position. With such a substitute adjustment screw 76, the mounting position of the first arm 50*a* of the spring 34 is changed from the state shown in FIG. 13A in the clockwise direction in FIG. 13A. This allows the second arm 50*b* to coincide in direction with the dot and dash line.

Figure 14A:
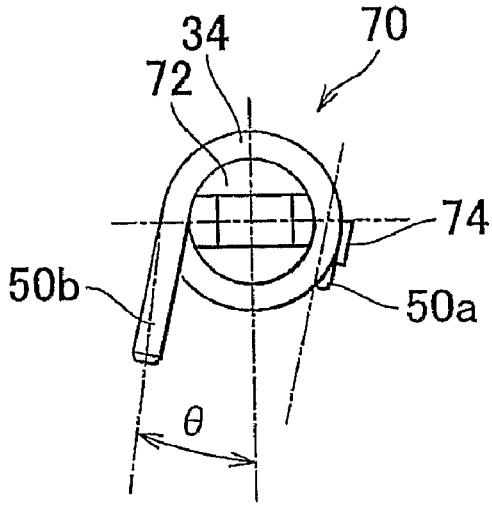
FIGS. 14A and 14B illustrate a method to adjust the mounting position of a spring with two wide-angled arms.
Figure 14B:
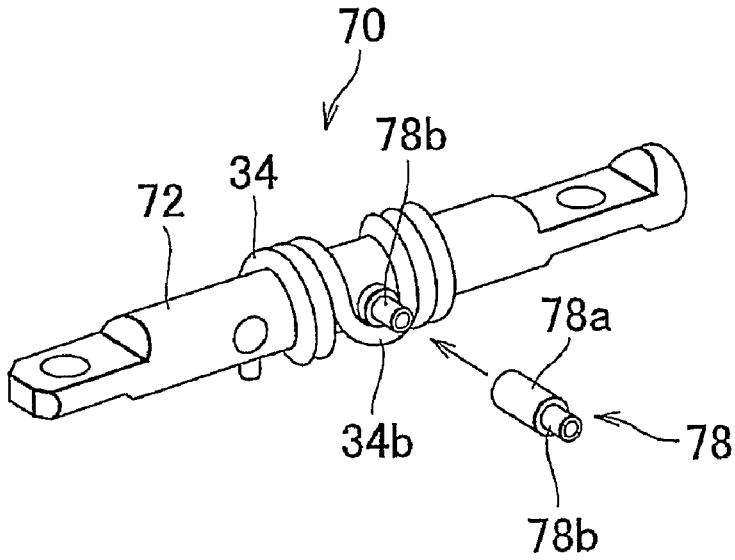

FIGS. 14A and 14B illustrate a method of adjusting the mounting position of the spring 34 with two wide-angled arms. In the case where a spring with two wide-angled arms, such as the spring 34 shown in FIG. 14A, is used, the adjustment screw 74 is replaced by an adjustment screw 78 that includes a cylindrical portion 78*b* having a smaller outer diameter compared to the screw 74, as shown in FIG. 14B. More specifically, the adjustment screw 78 includes a cylindrical portion 78*b* having a smaller outer diameter compared to the adjustment screw 74 including the cylindrical portion 74*b* having an outer diameter achieving the central position. With such a substitute adjustment screw 78, the mounting position of the first arm 50*a* of the spring 34 is changed from the state shown in FIG. 14A in the counterclockwise direction in FIG. 14A. This allows the second arm 50*b* to coincide in direction with the dot and dash line.

The adjustment of the spring position described above may be performed by the following procedure, for example. First, the spring 34 is mounted on the spring support shaft 72 using the adjustment screw 74 achieving the central position. Then, such an assembly of the spring support shaft 72 and the spring 34 is set on a predetermined measurement jig to measure the position of the second arm 50*b* relative to the reference plane (see FIGS. 12A to 12B). Then, if a variation is found in position of the second arm 50*b*, the adjustment screw 74 is replaced by an adjustment screw that includes a cylindrical portion that contacts the spring 34 with a different outer diameter, thus allowing the mounting position of the first arm 50*a* to be adjusted by the methods shown in FIGS. 13A to 14B. In this case, a plurality of adjustment screws may be provided including a cylindrical portion having a different outer diameter by a predetermined amount for every degree of torsion angle ?, for example. Adjustment work described above is performed for the spring 34 for each cylinder.

As described above, the spring position adjustment mechanism 70 according to this embodiment can change the mounting angle of the first arm 50*a* relative to the spring support shaft 72 by using an adjustment screw that has a cylindrical portion in contact the spring 34 of a different outer diameter, thus allowing the direction of the second arm 50*b* in the free state to be changed. Therefore, the spring force of the mounted lost motion spring 34 under maximum deflection may be set to the design reference value, irrespective of variations in shape of the lost motion spring 34, also by changing the direction of the second arm 50*b* through the spring position adjustment mechanism 70. In addition, the same effects as in the first embodiment discussed above can be achieved.

In the second embodiment discussed above, the spring position is adjusted by using an adjustment screw having a cylindrical portion with a different outer diameter. However, the member for adjusting the spring position in the present invention is not limited to a screw to be inserted into the spring support shaft, and may be an adjustment pin to be press-fitted into the spring support shaft, for example. In such a case, a plurality of adjustment pins including a cylindrical portion having different outer diameters may be provided for adjusting the spring position.

The cylindrical portion 74*b* of the adjustment screw 74 in the second embodiment discussed above is an embodiment of "cylindrical portion" in the present invention.

Figure 15:
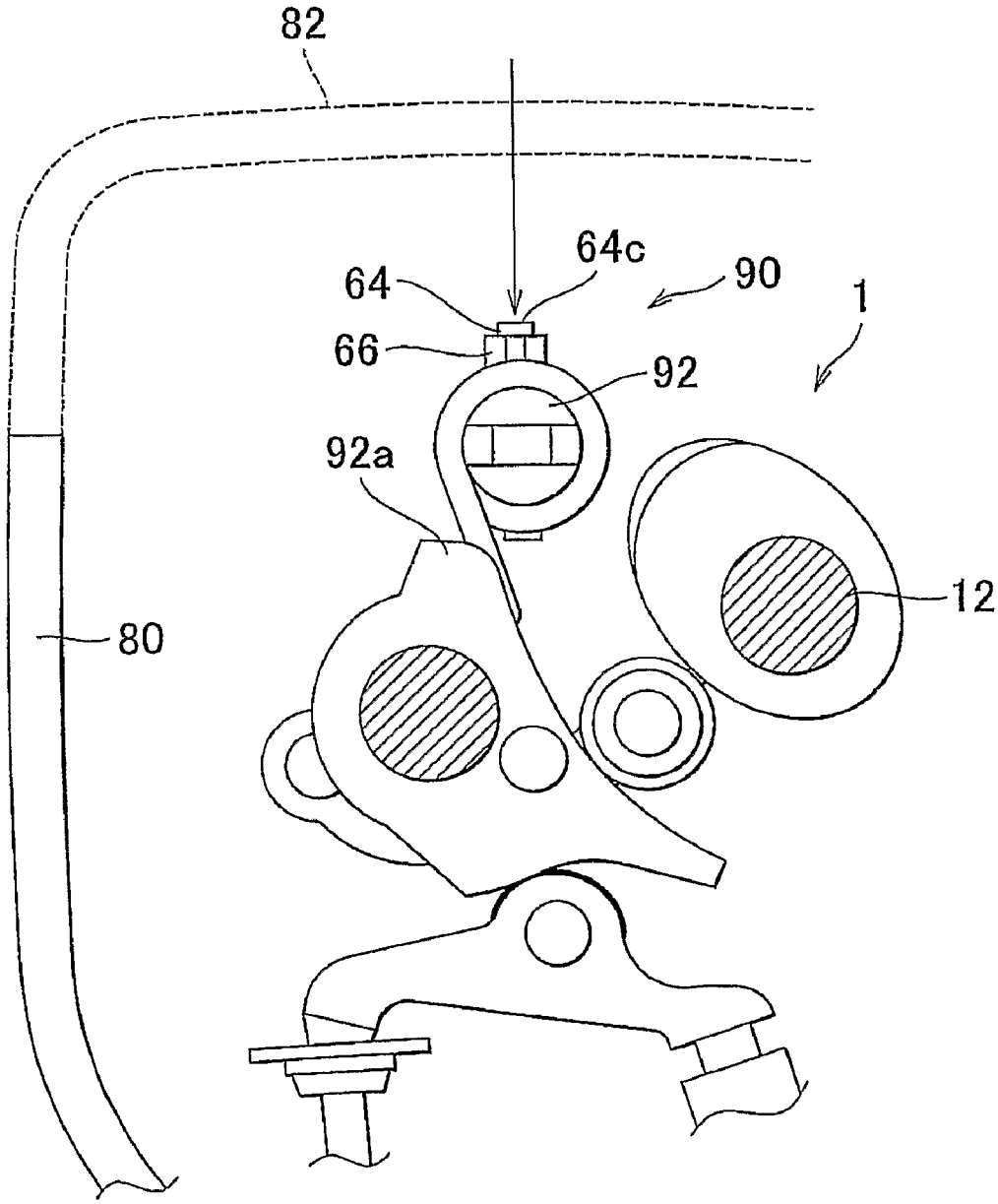
FIG. 15 illustrates the mounting direction of the spring position adjustment mechanism relative to a cylinder head of an internal combustion engine.

Next, with reference to FIG. 15, a third embodiment of the present invention will be described. FIG. 15 illustrates the mounting direction of a spring position adjustment mechanism 90 relative to a cylinder head 80 of an internal combustion engine. The construction of the spring position adjustment mechanism 90 shown in FIG. 15 is basically the same as that of the spring position adjustment mechanism 60 discussed above, except for the mounting arrangement to the cylinder head 80 via the spring support shaft 92, which will be described below.

As shown in FIG. 15, in this embodiment, the mounting position of the spring position adjustment mechanism 90 relative to the cylinder head 80, and the position of the retention part 92*a*, or the like, for the lost motion spring 34, or the like, in the variable valve driving mechanism 20 and the fixed valve driving mechanism 40, are determined such that the adjustment groove 64*c* in the adjustment screw 64 for rotational position adjustment is oriented upwardly of the cylinder head 80. In other words, the mounting position of the spring position adjustment mechanism 90 and the position of the retention part 92*a* are oriented so that the adjustment groove 64*c* is accessible when the head cover 82 is removed, and more specifically, is accessible in the substantially axial direction of the adjustment screw 64 when the head cover 82 is removed.

According to the construction of the embodiment described above, workability in adjusting the position of the spring 34, or the like, when the spring 34 is mounted on the variable valve driving device 1 is improved. Specifically, variations between cylinders in spring force of the spring 34, or the like, may be easily adjusted while the torsion spring mounted on the variable valve driving device 1.

In the third embodiment discussed above, the mounting arrangement for the spring position adjustment mechanism 90 that adjusts the spring position in the same way as the spring position adjustment mechanism 60 in the first embodiment is described. However, such a mounting arrangement may not necessarily be applied to a spring position adjustment mechanism thus constructed, and may also be applied to a spring position adjustment mechanism that adjusts the spring position in the same way as the spring position adjustment mechanism 70 in the second embodiment. Specifically, the mounting position of the spring position adjustment mechanism 70 relative to the cylinder head 80, and the like, may be determined in such an orientation that as the adjustment groove 74*c* is accessible in the substantially axial direction of the adjustment screw 74 when the head cover 82 is removed.

In the first to third embodiments discussed above, the lost motion spring 34 is mounted on the spring support shaft 62 that is inserted into its coil portion 34*c*. However, the support part for supporting the lost motion spring 34 is not limited to the spring support shaft 62 or similar structures. Instead, the support part in the present invention may be a stationary member such as cylinder head or another member fixed to the stationary member, as long as it can support one arm of a torsion spring.

Also, in the first to third embodiments discussed above, the oscillating cam arm 28 of the variable valve driving mechanism 20 and the large lift arm 44 of the fixed valve driving mechanism 40 serve as examples of the oscillating member to be impelled toward the driving cam 14 by the lost motion spring 34 for illustrative purposes. However, the oscillating member that is impelled by a torsion spring in the present invention is not limited thereto, as long as it needs to be impelled by a torsion spring when it oscillates within a predetermined oscillating range in order to maintain contact with a cam. For example, if a valve driving device for an internal combustion engine includes a valve deactivating mechanism, the oscillating member may be interposed between a deactivating valve and a cam that oscillates while maintaining contact with the cam even when the valve is deactivated.

The invention claimed is:

1. A valve driving device for an internal combustion engine, that includes an oscillating member interposed between a cam and a valve that synchronizes the oscillation of the valve with the rotation of the cam, the valve driving device comprising:

a torsion spring, having a first portion and a second portion, that contacts the oscillating member at the first portion and impels the oscillating member toward the cam;

a support part that supports the second portion of the torsion spring; and a spring position adjustment mechanism that adjusts a mounting position of the torsion spring relative to the support part.

2. The valve driving device for an internal combustion engine according to claim 1, wherein the spring position adjustment mechanism includes an adjustment member having a projection projecting from the support part, and the second portion of the torsion spring surrounds the projection, the adjustment member is rotatably mounted on the support part, and the projection has a cam-shaped peripheral surface that contacts the second portion of the torsion spring.

3. The valve driving device for an internal combustion engine according to claim 2, wherein the second portion of the torsion spring is formed in a U shape, and the semicircular portion of the U shape surrounds the projection.

4. The valve driving device for an internal combustion engine according to claim 2, wherein the mounting position of the torsion spring relative to the support part is adjusted by rotating the projection.

5. The valve driving device for an internal combustion engine according to claim 2, wherein the adjustment member is mounted on the support part in an orientation such that when a head cover of the internal combustion engine is removed, the adjustment member is accessible.

6. The valve driving device for an internal combustion engine according to claim 1, wherein the spring position adjustment mechanism includes an adjustment member having a projection projecting from the support part, the second portion of the torsion spring surrounds the projection, the projection includes a cylindrical portion that contacts the second portion of the torsion spring, and the spring position adjustment mechanism adjusts the mounting position of the torsion spring relative to the support part by using the adjustment member including the cylindrical portion, in contact with the torsion spring, having a different outer diameter.

7. The valve driving device for an internal combustion engine according to claim 6, wherein the adjustment member is mounted on the support part in an orientation such that when a head cover of the internal combustion engine is removed, the adjustment member is accessible.

8. The valve driving device for an internal combustion engine according to 7, wherein the adjustment member is mounted on the support part in an orientation such that when a head cover of the internal combustion engine is removed, the adjustment member is accessible in a substantially axial direction of the adjustment member.

* * * * *